United States Patent [19]

Pulichino, Jr.

[11] Patent Number: 4,927,014

[45] Date of Patent: May 22, 1990

[54] GARMENT BAG WITH FLAP COVER FOR STRAP HOOK

[75] Inventor: John V. Pulichino, Jr., Providence, R.I.

[73] Assignee: American Tourister, Inc., Warren, R.I.

[21] Appl. No.: 371,108

[22] Filed: Jun. 26, 1989

[51] Int. Cl.[5] ..... A95C 5/06; A95C 5/12; A95C 13/10; A95C 13/34; A40C 5/12

[52] U.S. Cl. ..... 206/287.1; 206/293; 190/119; 292/DIG. 48

[58] Field of Search ..... 206/278, 287, 287.1, 206/292, 293, 279, 284; 190/110, 119; D3/71; 383/23, 86; 248/339, 339 H, 359 I; 292/DIG. 42

[56] References Cited

U.S. PATENT DOCUMENTS

| | | | |
|---|---|---|---|
| D. 292,745 | 11/1987 | Allen | D3/21 X |
| 2,596,412 | 5/1952 | Kish, Jr. et al. | 206/287.1 X |
| 2,689,631 | 9/1954 | Marks | 206/287.1 X |
| 3,273,678 | 9/1966 | Koret | 206/287 X |
| 3,335,826 | 8/1967 | Swirles | 206/287.1 |
| 4,189,036 | 2/1980 | Pelavin | 206/287.1 X |
| 4,542,824 | 9/1985 | Allen | 206/287.1 |
| 4,685,560 | 8/1987 | King | 206/287.1 |
| 4,693,368 | 9/1987 | King et al. | 206/287.1 |
| 4,753,342 | 6/1988 | Pulichino, Jr. et al. | 206/287.1 X |
| 4,817,791 | 4/1989 | Adams | 206/287.1 |

*Primary Examiner*—Sue A. Weaver
*Attorney, Agent, or Firm*—Wood, Herron & Evans

[57] ABSTRACT

A garment bag formed by two fabric walls hinged together along one side edge and enclosed on the remaining edges by a slidable fastener. A carrying strap having a wide foam-backed pad distributes the weight when shoulder carrying a loaded bag. When folded upon itself, it has a hanger spanning adjoining edges and secured in a retainer loop. A retainer flap overlies the hanger and loop to keep the hanger in the loop. A waterproof pocket is formed integrally with one of the bag walls.

1 Claim, 2 Drawing Sheets

GARMENT BAG WITH FLAP COVER FOR STRAP HOOK

BACKGROUND OF THE INVENTION

This invention relates to a garment bag.

A garment bag as described herein is a clothing carrier consisting of two elongated fabric walls which are hinged together along one edge of the walls. In the preferred embodiment, the hinge is along a longitudinal or elongated edge. A slide fastener is provided around the free edges to close the bag around the clothes packed within it. Within the bag, provision is made for mounting clothes hangers to a top edge for hanging dresses, skirts and suits. Pockets are provided around the bag walls for packing other articles of clothing, including shoes. It is not uncommon to pack the bag with 30–35 pounds of clothes.

When packed and closed, the closed bag is folded upon itself to provide a convenient suitcase-size article for carrying. A shoulder strap transversely spans the fold line and a hand grip handle is mounted on the fold line to permit carrying either by hand or by shoulder. In a conventional, fully loaded garment bag, the shoulder strap tends to dig into the shoulder and introduces an element of discomfort, particularly when the bag must be carried over a relatively long distance.

The garment bag has at least one external hanger attached to the top edge of one of the bag walls. The hanger is used to support the bag, on a door for example, during packing. The hanger is used to support the fully packed bag in an unfolded attitude. In the unfolded attitude, the clothes have the opportunity to hang relatively loosely to minimize wrinkling.

Finally, the hanger functions to hold the adjoining top and bottom free ends of the garment bag together when the bag is folded upon itself. To this end, the lower end of the bag has a fabric loop. The hanger extends across the adjoining ends of the folded bag and passes through the loop where it is frictionally held. In application Ser. No. 07/320,525, filed Mar. 8, 1989, structure is described for shortening or lengthening the hanger to permit a slight tension on the hanger as it spans the adjoining ends of the bag when the bag is lightly packed or when the bag is fully packed. In either case, the hanger, frictionally held in the loop, has a tendency to slip out of the loop during the jostling encountered in carrying the bag. It will then drag along the floor or ground, subjecting it to scratching and indeed being a nuisance to the person carrying the bag.

In a garment bag as well as in other types of clothes-carrying cases, it is customary to provide a waterproof bag to keep a wet swimsuit, wet clothing and the like isolated from the remaining clothes. The waterproof bag is somewhat of a nuisance, as it is in the way during packing and it can easily be forgotten by being temporarily removed from the bag during packing.

SUMMARY OF THE INVENTION

It has been an objective of the present invention to provide improvements to the garment bag eliminating the problems discussed above.

This objective of the invention is attained, in part, by providing a wide foam-backed strap pad slidably mounted on the shoulder strap. The wide pad is adapted to be positioned between the strap and the shoulder and performs two very valuable functions. First, it is thick and relatively stiff so as to distribute the load from the relatively thin strap over a wide area on the shoulder. Second, the foam pad provides a coefficient of friction between the pad and the clothes of the person carrying the bag to keep the strap from slipping off the shoulder.

The objective is further attained by providing a hanger-retaining flap attached adjacent the retainer loop on the bottom end of the garment bag. The hanger-retaining flap has a hook and loop (Velcro) fastener for holding it over the hanger-in-loop combination after the hanger is inserted in the loop. The combination of retainer flap and hanger-in-loop provides assurance that the hanger will not be jostled free of its loop during carrying of the bag.

The objective of the invention is further attained by providing, within the garment bag, an integral waterproof pocket consisting of a waterproof lining over a portion of one of the bag walls and an overlying waterproof pocket panel. Preferably, a zipper is provided to close the integral waterproof pocket. The pocket thus is barely noticeable during packing and unpacking, but is there when it is needed.

BRIEF DESCRIPTION OF THE DRAWINGS

The objectives and features of the invention will become more readily apparent when taken in conjunction with the accompanying drawings in which.

DETAILED DESCRIPTION OF THE INVENTION

Figure 1:
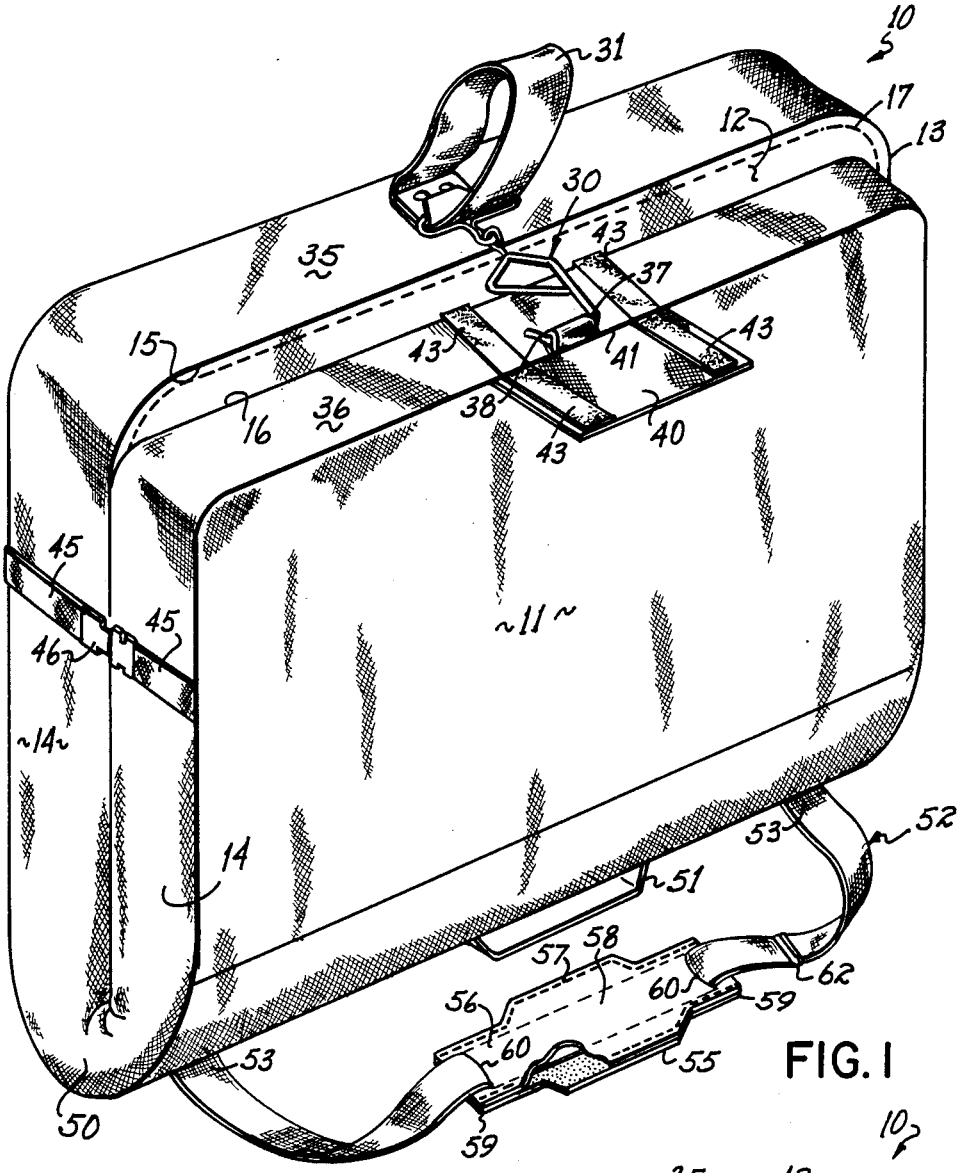
FIG. 1 is a perspective view of a garment bag folded upon itself.
Figure 3:
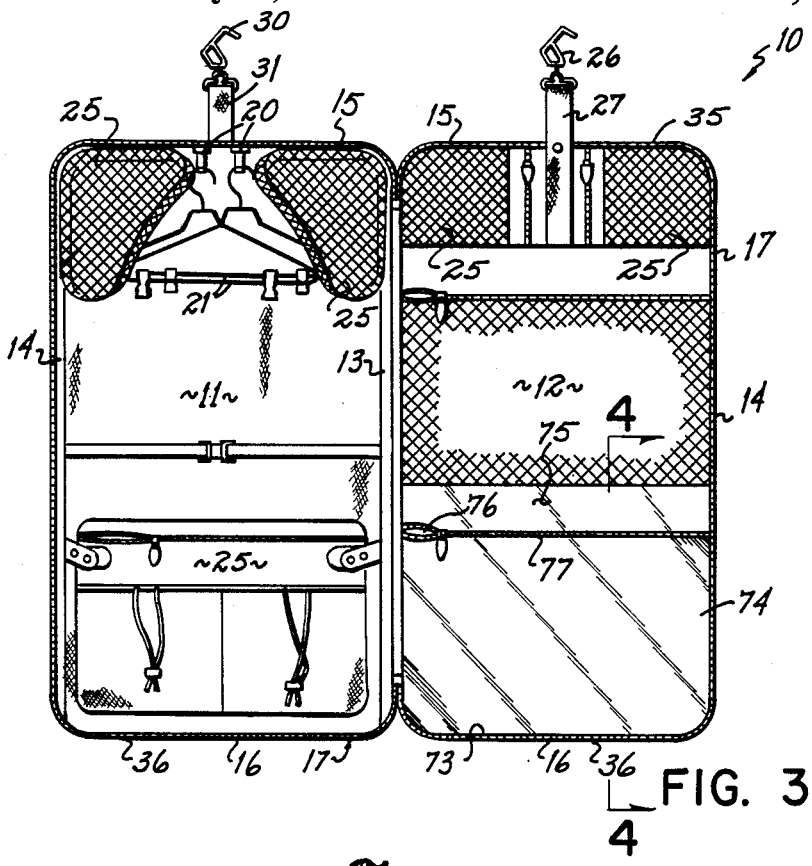
FIG. 3 is an elevational view of the garment bag in an unpacked, unfolded, open condition.

Referring particularly to FIGS. 1 and 3, a garment bag 10 is shown as having a first elongated wall 11 and a second elongated wall 12. Each wall has side edges 13, 14, a top edge 15 and a bottom edge 16. The walls 11 and 12 are permanently hinged together along the longitudinal edges 13. A slide fastener 17 that extends around top and bottom edges 15 and 16 as well as outboard edges 14 is provided to close the bag when wall 12 is folded upon wall 11. Internally, the bag has retainer 20 for clothes hangers 21 on which garments such as dresses, skirts and suits are hung. Compartments 25 of various sizes and shapes are provided on both walls for retention of garments, including shoes, of varying types. An internal hanger 26 is fixed by a strap 27 to the top edge 15 of wall 12. The primary function of the hanger 26 is to support the wall 12 on a door while the bag is open during packing. An external hanger 30 is connected by a strap 31 to the top edge 15 of wall 11. The external hanger also functions to support the bag on a door during packing. It can be seen that the hangers 26 and 30 will provide a very convenient mounting of the bag in its open condition so as to facilitate the packing procedure.

The external hanger 30 also is available to support the bag when it is in a closed but unfolded attitude, thereby permitting the clothes within it to hang loosely as well as to permit the bag to be hung conveniently in aircraft closets of limited space.

Figure 2:
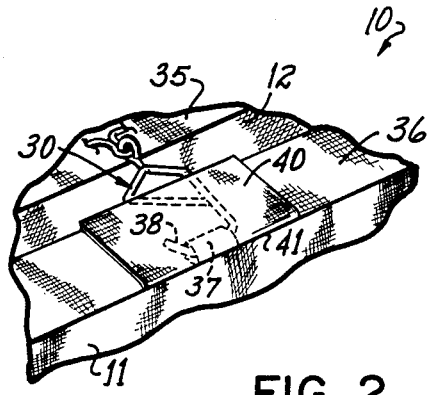
FIG. 2 is a fragmentary perspective view of the retainer flap and hanger-in-loop combination.

Finally, as shown in FIGS. 1 and 2, the hanger 30 is used to hold the top end 35 and the adjoining bottom end 36 of the clothes bag together when the bag is in the folded condition of FIG. 1. To this end, a fabric retainer loop 37 is stitched to the bottom end 36 of wall 11. The hanger 30 has a hook portion 38 that passes through the retainer loop 37 to hold the two ends 35 and 36 together and to be retained in the loop 37. A fabric retainer flap 40 is stitched along an edge 41 to the bottom 36 end of the wall 11. The retainer flap 40 is immediately adjacent the retainer loop 37. Spaced parallel hook and loop (Velcro) fastener strips 43 are mounted on the edges of the flap 40 and on the bottom end 36 of the bag, respectively. When the retainer flap is folded over the hanger-in-loop as shown in FIG. 2, the fastener secures the flap in that overlying position. It can thus be seen in referring to FIG. 2 that while the fasteners of the retainer flap are in engagement, it is impossible for the hanger 30 to become dislodged from the loop 37. It should be understood that fasteners, such as snap fasteners, could be employed, although the hook and loop fasteners are preferred.

Lateral straps 45 with mating fasteners 46 are provided along the adjoining side edges 13 and 14 of the garment bag to assist in holding the garment bag in its folded attitude as shown in FIG. 2.

In its folded attitude, a fold line or area 50 is created. A handle 51 is mounted on that line. A shoulder strap 52 has ends 53 secured to that fold line, preferably with removable separable fasteners, not shown, so that the shoulder strap can be removed when not needed. Shoulder strap 52 is a thin fabric member. To it a pad 55 is slidably mounted. The pad 55 is formed of a small cell foamed plastic. It is about ¼ inch thick and is relatively stiff, the stiffening being augmented by an overlying leather-like ply 56 which is stitched as at 57 around the perimeter of the two elements. The pad has a central section 58 which is about 3½ inches in transverse dimension and 4½ inches in longitudinal dimension, that is, in the direction of the strap 52. At its ends, the pad has tabs 59 of about 2¼ inches in a transverse dimension and 3¾ inches in a longitudinal dimension. The leather-like ply 56 has slots 60 in each end through which the strap 52 can pass. The combination of foam pad and covering ply 56 provides a slidable mounting of the pad to the strap so as to permit the pad to be centered on the strap at any adjusted length of the strap. The strap has a conventional slidable loop 62 provided for adjusting the length of the strap.

The pad 55 is wide to provide a large area of engagement with the shoulder of the person carrying the bag. It is relatively stiff in part through its own stiffness and in part through the reinforcement by the leather-like ply 56 so as to distribute the weight imparted to it by the thin fabric strap 52. Thus, the combination of the foam material, the thickness of the foam material and the stiffness of the combination provides a very comfortably distributor for the weight of the bag over a large area of the carrier's shoulder with the foam additionally providing a friction engagement to prevent the slipping of the strap off the shoulder.

Figure 4:
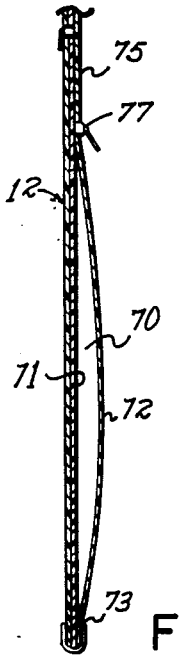
FIG. 4 is a cross-sectional view taken along lines 4—4 of FIG. 3 illustrating the waterproof pocket.

Referring to FIGS. 3 and 4, a waterproof pocket 70 is formed in about the lower third of wall 12. To that end, the wall 12 has a waterproof lining 71 permanently secured to it. Overlying the lining 71 is a waterproof pocket panel 72. The pocket panel is stitched along its bottom edge 73 and its side edges 74 and its top edge 75 to the wall 12. Spaced slightly below the top edge 75 is an opening 76 in the pocket panel 72. A slide fastener 77 is mounted across the opening so as to open or close the pocket 70 as needed.

From the above description, it can be seen that the waterproof pocket or wet bag is formed integrally with the garment bag, but the plies forming it are so thin that it is not noticeable and certainly not in the way during packing and unpacking. Nevertheless, it is always available when it is needed. It can of course be used for things other than wet garments such as dirty clothes ready for laundering, but it is fully waterproof in the event that a wet swimsuit or the like is to be carried in it.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A garment bag comprising:

an elongated bag having free ends, a carrying handle and strap at the center of said bag, said bag being foldable upon itself to bring said free ends together to form the lower end of the bag when it is carried by said handle or strap, a hook connected by a long, flexible strap to one free end, a retaining loop on the other free end to receive said hook to hold said free ends together, a flap hinged to said other free end adjacent said retaining loop, hook-and-loop fastener means on said flap and free end, respectively, to secure said flap against said free end overlying said hook when said hook is in said retaining loop, thereby keeping said hook from dangling when said bag is being carried by said handle or strap.

* * * * *